United States Patent [19]

Bowditch

[11] Patent Number: 4,462,118

[45] Date of Patent: Jul. 31, 1984

[54] METHOD OF MAKING A FLAT PLANE SEAM GARMENT

[75] Inventor: Philip N. Bowditch, Cohasset, Mass.

[73] Assignee: The Charles Stark Draper Laboratory, Inc., Cambridge, Mass.

[21] Appl. No.: 500,003

[22] Filed: Jun. 1, 1983

[51] Int. Cl.[3] ..... A41D 00/00

[52] U.S. Cl. ..... 2/243 R; 2/143; 2/243 A; 2/243 B

[58] Field of Search ..... 2/143, 243 B, 243 R, 2/243 A, DIG. 7

[56] References Cited

U.S. PATENT DOCUMENTS

| | | | |
|---|---|---|---|
| 2,347,578 | 4/1949 | Roher | 2/243 R |
| 2,494,169 | 1/1950 | Formichella . | |
| 2,896,219 | 7/1959 | Clyne . | |
| 3,500,479 | 3/1970 | Pierron . | |
| 3,574,238 | 4/1971 | McCurry . | |
| 3,585,641 | 6/1971 | Pierron . | |
| 3,594,821 | 7/1971 | Pierron | 2/243 R |
| 3,663,962 | 5/1972 | Burger . | |
| 3,678,516 | 7/1972 | Backer . | |
| 3,696,445 | 10/1972 | Craig . | |
| 3,699,591 | 10/1972 | Breitkopf . | |
| 3,701,165 | 10/1972 | Huddleston . | |
| 3,798,678 | 3/1974 | Pierron et al. . | |
| 3,828,367 | 8/1974 | Bourgeois . | |
| 3,869,997 | 3/1975 | German . | |
| 3,896,749 | 7/1975 | Brauns et al. . | |
| 4,055,859 | 11/1977 | Green et al. . | |
| 4,304,007 | 12/1981 | Ito . | |

*Primary Examiner*—Werner H. Schroeder
*Assistant Examiner*—Mary A. Ellis
*Attorney, Agent, or Firm*—Lahive & Cockfield

[57] ABSTRACT

A method for assembling pants from two substantially identical fabric panels using flat plane seams for joining the two panels. The pants are assembled according to the sequential steps of first positioning one of the panels in a plane, then overlaying the other of the panels on the first panel. Then the crotch seam regions of the first panel are joined to the corresponding overlying crotch seam regions of the second panel to form two flat plane segments of the crotch seam. Then, the leg portion of one of the panels is folded 180 degrees about a first fold axis which passes through the junction points of the contiguous inseam and crotch regions of the panel. Thereafter, the panels are folded 180 degrees about a second fold axis passing between the first and second sides, so that the inseam regions of each panel are mutually adjacent. Finally, the adjacent inseam regions are joined thereby forming the flat plane inseam, and also joining the two segments of the crotch seam to form the flat plane crotch seam. With this configuration, the pants are formed from the two panels entirely with flat plane seam joining techniques.

1 Claim, 5 Drawing Figures

METHOD OF MAKING A FLAT PLANE SEAM GARMENT

BACKGROUND OF THE INVENTION

The present invention is in the field of clothing and more particularly relates to the design and assembly of garments.

Garments have long been made by joining two or more panels of limp fabric to form seams, so that the composite surface of the joined panels forms a desired three dimensional contour. Typically, the design process for a garment includes the step of segmentation of the desired finished contour into planar patterns having shapes corresponding to panels for the garment. These patterns are used to generate the panels which may be cut from a portion of a limp fabric while that portion is positioned in a plane.

Thus, to manufacture the garment using the pattern, the patterns are used to define the contours of the panels on a portion of fabric, and the panels are cut from that portion. Thereafter, the cut panels are joined to form the garment. In order to efficiently produce large numbers of garments, for example in commercial production, the panels may be cut from elongated strips of fabric extending from bolts of the fabric. Various computer controlled systems have been developed in the prior art to accomplish the garment production from such bolts. For example, there are known systems for automatically laying out panels, accommodating a full range of garment sizes, on a strip of material from a bolt which maximizes fabric utilization (i.e. minimizes waste). There are also computer controlled cutting systems, for example using reciprocating knives, which very accurately and quickly cut the panels from a large number of strips at a time. Further, there are systems which can automatically position the cut panels so that certain of their edges-to-be-joined may be joined by sewing, or fusing, under the control of a computer.

One of the principle limitations of the prior art clothing assembly techniques is that automatic, or computer controlled, joining systems can only effectively perform panel edge joining in a flat plane. That is, the seam must lie in a plane. Since many garments include seams which may be formed in a flat plane, automated systems have been very effective in enabling the efficient production of garments. For example, U.S. Pat. No. 3,699,591 shows a system for manufacturing simple garment which includes only flat plane seams which may readily be performed by known systems.

However, most garments must be assembled with at least some seams which are not flat plane seams; that is, the garment design includes seams which cannot be formed in a plane, or at least it is not known how to form such seams in a plane. By way of example, a pair of pants might be formed from two panels which are joined with an inseam and crotch seam intersecting at a saddle region, with the inseam extending between the lowermost portions of the leg portions of the pants and the crotch seam extending between two points on the top of the pants. Using conventional assembly techniques for such pants, one of these seams is first formed in its entirety and then the other is formed. This operation cannot be performed with flat plane seams. In order to assemble such garments in the prior art, these non-flat plane seams cannot be formed using known automated seam joining systems, but rather must be formed either by hand or, more typically, human operator-controlled feeding of the panels to a sewing machine (or other type of joining) head. Consequently, the labor cost is relatively high compared to that encountered for a garment which might be assembled entirely by a computer system.

It is an object of the present invention to provide an improved method of garment assembly.

It is another object to provide a method of assembly of pants using flat plane seam joining techniques.

SUMMARY OF THE INVENTION

Briefly, the present invention is directed to a method for assembling pants from two substantially identical fabric panels using flat plane seams for joining the two panels. The pants have a continuous flat plane inseam intersecting with a continuous flat plane crotch seam at a saddle region. The inseam extends from the lowermost portions of one of the legs of the pants to the lowermost portion of the other of the legs of the pants. The crotch seam extends between two points on the top, or waist region, of the pants. Each of the fabric panels includes an upper portion and a leg portion, and includes on one side an inseam region and a crotch seam region contiguous thereto, and on the opposite side, a similar inseam region and crotch seam region contiguous thereto. The crotch seam regions define the upper portions of the panels and the inseam regions define the leg portions of the panels.

According to the invention, the pants are assembled according to the sequential steps of first positioning one of the panels in a plane, then overlaying the other of the panels on the first panel. Then the crotch seam regions of the first panel are joined to the corresponding overlying crotch seam regions of the second panel to form two flat plane segments of the crotch seam. In this latter step, the crotch seam is not completed in its entirety since two disconnected portions of that seam are established.

Then, the leg portion of one of the panels is folded 180 degrees about a first fold axis which passes through the junction points of the contiguous inseam and crotch regions of the panel. Thereafter, the panels are folded 180 degrees about a second fold axis passing between the first and second sides, so that the inseam regions of each panel are mutually adjacent. Finally, the adjacent inseam regions are joined thereby forming the flat plane inseam, and also joining the two segments of the crotch seam to form the flat plane crotch seam. With this configuration, the pants are formed from the two panels entirely with flat plane seam joining techniques.

The present invention is particularly useful for certain apparel such as surgical garments, and other non-fashion driven wearable items not requiring specialized construction for tailored fits.

BRIEF DESCRIPTION OF THE DRAWINGS

The foregoing and other objects of this invention, the various features thereof, as well as the invention itself, may be more fully understood from the following description, when read together with the accompanying drawings in which.

DESCRIPTION OF THE PREFERRED EMBODIMENT

Figure 1:
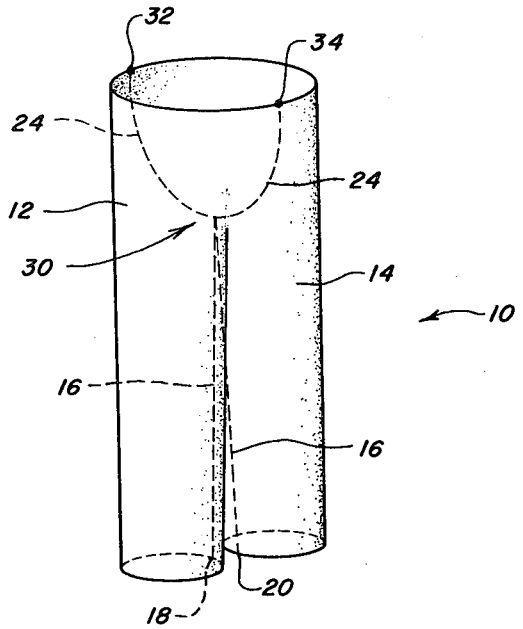
FIG. 1 shows a pair of pants.

FIG. 1 shows a simply designed pair of pants 10, suchas might be used as a surgical garment. The pants 10 are constructed from two substantially identical panels, shown in FIG. 2. When assembled, the pants include an inseam 16 extending between two points 18 and 20 on the lowermost portion of the respective legs of the pants. The inseam 16 intersects with a crotch seam 24 at a saddle region 30. The crotch seam 24 extends between two points 32 and 34 at the top of the pants.

Figure 2:
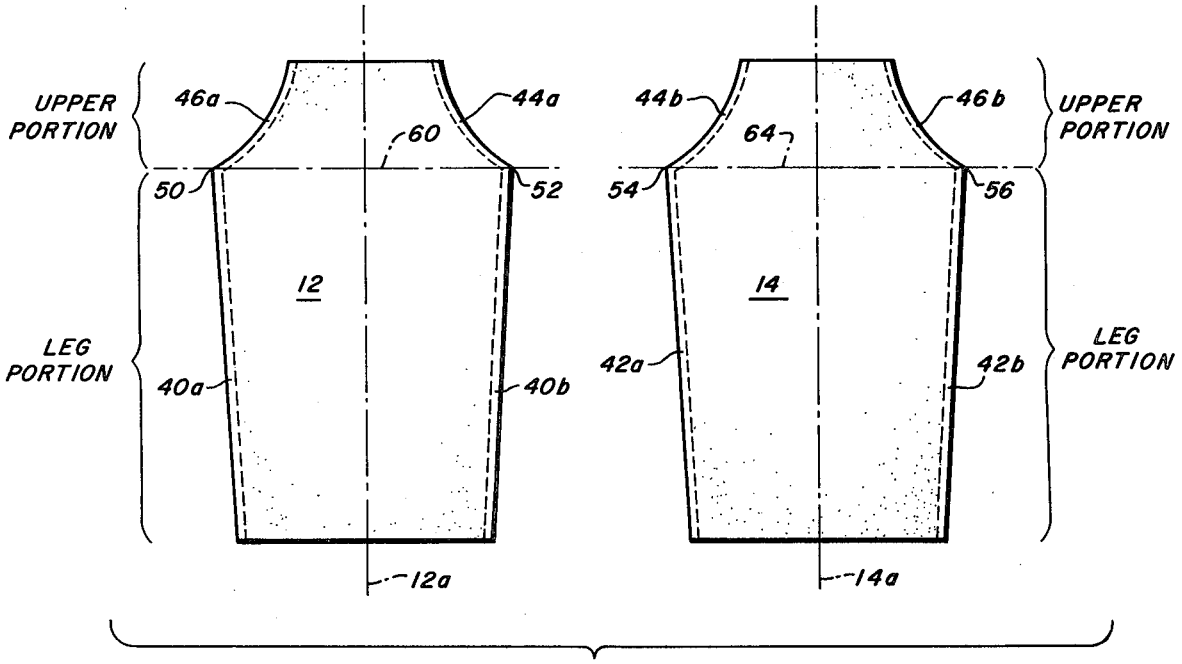
FIG. 2 show two panels for the pants of FIG. 1.

The panels 12 and 14 are shown with no seams joined, in planar form, in FIG. 2. In the present embodiment, each of panels 12 and 14 is substantially symmetrical about an associated longitudinal axis (axes 12*a* and 14*a*, respectively), although in other embodiments, the substantially identical panels 12 and 14 may not be so symmetrical.

The panel 12 is bounded on one side by an inseam region 40*a* (set off by dotted lines in FIG. 2) and a crotch seam region 46*a* (set off by dotted lines). The regions 40*a* and 46*a* are contiguous, joining at a point 50. Similarly, the other side of panel 12 is bounded by an inseam region 40*b*, and a crotch seam region 44*a*. These regions 40*b* and 44*a* are contiguous and join at a point 52.

Panel 14 is again similar to panel 12 and is bounded on one side by an inseam region 40*a* and crotch seam region 44*b*, with those regions being contiguous and joining at point 54, and bounded on the other side by an inseam region 42*b* and crotch seam region 46*b* which are contiguous, joining at point 56.

A reference axis 60 passing through points 50 and 52, as shown in FIG. 2, divides the panel 12 into an upper portion bounded by regions 44*a* and 46*a* and a leg portion bounded on its side by regions 40*a* and 40*b*. Similarly, a reference axis 64 passing through points 54 and 56 of panel 14, divides that panel into an upper portion defined on its sides by regions 44*b* and 46*b* and a leg portion defined on its sides by regions 42*a* and 42*b*.

The pant configuration shown in FIGS. 1 and 2 is a conventional configuration. To assemble this configuration according to the prior art, the panels 12 and 14 first have their respective pairs of inseam regions joined, that is, first region 40*a* is joined to 40*b*, and then region 42*a* is joined to region 42*b*, thereby establishing two substantially tubular sections representing the legs of the garment. These inseam joining operations may readily be accomplished with a flat plane joining techniques. Then, the crotch seam is formed by joining region 44*a* to region 44*b*, followed by the joining of region 46*a* to region 46*b*. This operation may not be performed using flat plane joining techniques since the garment is already formed into a three-dimensional shape due to the formation of the inseam segments.

Figure 3:
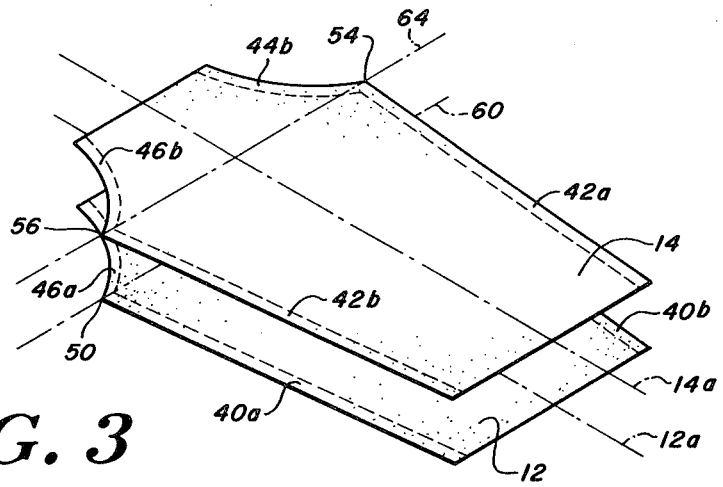
FIGS. 3–5 illustrate the method of sewing the panels of FIG. 2 in accordance with the present invention.
Figure 4:
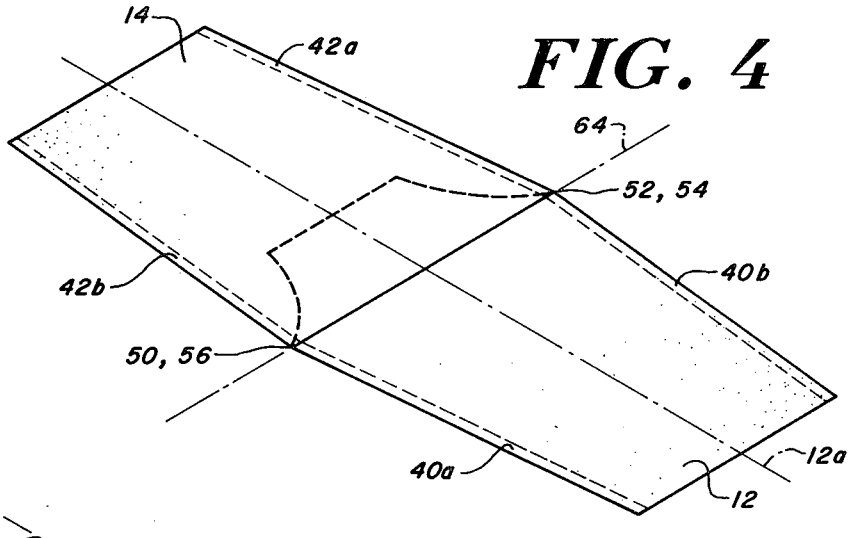
Figure 5:
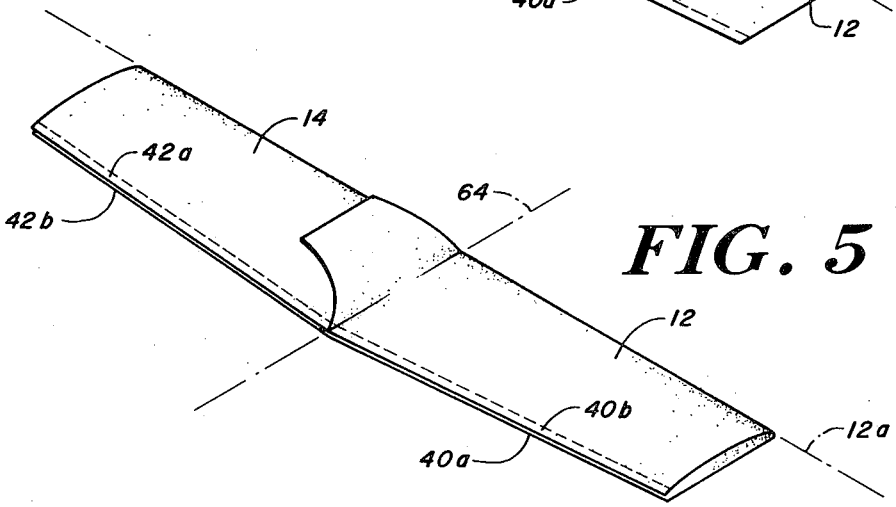

In accordance with the present invention, however, the garment may be assembled using entirely flat plane joining techniques, that is, where the panels are maintained in a substantially planar form during all seam joining operations. FIGS. 3–5 illustrate the method of joining the panels 12 and 14 in accordance with the present invention.

Initially, panel 12 is positioned in a plane and then the panel 14 is overlayed on top of panel 12, as shown in FIG. 3. The crotch seam in regions 46*a* and 46*b* are first joined to form one segment of the crotch seam and the crotch seam regions 44*a* and 44*b* are joined to form the other segment of the crotch seam. These seam joining operations are performed using flat plane techniques.

Then, the leg portion of panel 14 is folded 180 degrees about the axis 64 with the rest of the panels 12 and 14 remaining in the same position as shown in FIG. 3. The panels then have the configuration shown in FIG. 4. The portion of the panels on one side of axis 14*a* are the folded 180 degrees about that axis so that the inseam regions 42*a* and 42*b* are mutually adjacent and the inseam regions 40*a* and 40*b* are mutually adjacent. The panels then have the configuration shown in FIG. 5. Then, those mutually adjacent regions 42*a*, 42*b* and 40*a*, 40*b* are joined to form the entire inseam and, at the same time, join the two segments of the crotch seams. The latter seam joining operations are performed using flat plane techniques. Following these operations, the pants are now complete. It should be noted that all seaming operations were performed using flat plane techniques, and thus, the construction of the pants 10 may be readily performed using known flat plane joining systems. There is no necessity for operator intervention to position the fabric, other than to fold the various portions of the garment as specified. In alternative embodiments, the folding may readily be accomplished in using computer controlled, or automated, folding systems.

While the method described for the present exemplary process is defined in terms of a garment being substantially symmetrical about longitudinal axes, there may be variations from this configuration, for example, to accommodate garment which differ in shape from front to back.

The invention may be entitled in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. A method for assembling pants from two substantially identical fabric panels using flat plane seams for joining said two panels, said pants having a continuous flat plane inseam intersecting with a continuous flat plane crotch seam at a saddle region, said inseam extending from the lowermost portion of one of the legs of said pants to the lowermost portion of the other of the legs of said pants, and said crotch seam extending between two points on the top of said pants, wherein each of said fabric panels includes an upper portion and a leg portion and includes on one side an inseam region and a crotch seam region contiguous thereto and on the opposite side a similar inseam region and crotch seam region contiguous thereto, said crotch seam regions defining said upper portions of said panels and said inseam regions defining a leg portions of said panels, including the sequential steps of:

A. positioning one of said panels in a plane,

B. overlaying the other of said panels on said one panel,

C. joining the crotch seam regions of said one panel to the corresponding overlaying crotch seam regions of said other panel to form two flat plane segments of said crotch seam, D. folding the leg portion of one of said panels 180 degrees about a first fold axis passing through the junction points of said contiguous inseam region and crotch region of said panel, E. folding said panels 180 degrees about a second fold axis passing between said one side and said other side whereby said inseam regions of each panel are mutually adjacent, in a flat plane F. joining said adjacent inseam regions thereby forming said flat plane inseam and joining said two segments to form said flat plane crotch seam.

* * * * *